US005924706A

United States Patent [19]

Seltzer et al.

[11] Patent Number: 5,924,706

[45] Date of Patent: Jul. 20, 1999

[54] SKATE BOOT CONSTRUCTION

[75] Inventors: Edwin Seltzer, West Chester, Pa.; Ross J. Whitehead, Wilmington, Del.

[73] Assignee: Roller Cerby Skate Corporation, Litchfield, Ill.

[21] Appl. No.: 08/890,026

[22] Filed: Jul. 10, 1997

Related U.S. Application Data

[51] Int. Cl.[6] ..... A63C 3/02

[52] U.S. Cl. ..... 280/11.31; 280/11.3; 36/89

[58] Field of Search ..... 280/11.36, 11.3, 280/11.22, 11.31, 11.12, 11.18; 36/88, 89, 118.2

[56] References Cited

U.S. PATENT DOCUMENTS

| | | | |
|---|---|---|---|
| 4,308,673 | 1/1982 | Möbius . | |
| 4,351,537 | 9/1982 | Seidel | 280/11.12 |
| 4,385,456 | 5/1983 | Livernois et al. . | |
| 4,655,465 | 4/1987 | Schaeffer . | |
| 4,869,001 | 9/1989 | Brown . | |
| 5,142,798 | 9/1992 | Kaufman et al. | 36/118.2 |
| 5,317,820 | 6/1994 | Bell et al. . | |
| 5,397,141 | 3/1995 | Hoshizaki et al. | 280/11.3 |
| 5,430,960 | 7/1995 | Richardson . | |
| 5,437,466 | 8/1995 | Meibock et al. . | |
| 5,438,769 | 8/1995 | Mazzarolo . | |
| 5,462,295 | 10/1995 | Seltzer . | |
| 5,526,586 | 6/1996 | Foscaro | 36/88 |
| 5,645,288 | 7/1997 | Lu | 280/11.22 |

FOREIGN PATENT DOCUMENTS

| | | |
|---|---|---|
| 2110328 | 5/1995 | Canada . |
| 876299 | 7/1949 | Germany . |
| 9515094 | 6/1995 | WIPO . |

*Primary Examiner*—J J Swann
*Assistant Examiner*—Lynda Jasmin
*Attorney, Agent, or Firm*—Sixbey, Friedman, Leedom & Ferguson, PC

[57] ABSTRACT

The skate boot construction includes a unitary plastic heel/ankle counter insert which may be secured externally or internally to a soft boot mounted on a skate truck. The insert includes two spaced side portions joined by a U-shaped heel section which extend along the sides of a skater's foot. Above the side portions and the heel section are two forwardly projecting side flaps joined by an arcuate back section which are connected to the spaced side portions by two outwardly bowed hinge sections positioned over a skater's ankle bones. An arcuate slit extends through the heel/ankle counter between the heel section and arcuate back section and runs for a distance along either side of the heel/ankle counter. End slits extend transversely above and below each end of the arcuate slit. Cutaway portions below the side flaps extend inwardly toward the end slits and with the end slits define the edges of the bowed hinge sections.

6 Claims, 2 Drawing Sheets

SKATE BOOT CONSTRUCTION

TECHNICAL FIELD

The present invention relates to a skate boot construction including either an external or an internal heel/ankle counter which is designed for ice skates, or roller skates of either the in-line or quad type.

BACKGROUND ART

To achieve greater performance from roller skates, quad and in-line, and ice skates, skate designers and manufacturers continue to search for designs and manufacturing techniques to improve the handling, maneuverability, support, comfort, and durability which a skate can offer.

Early prior art skates were manufactured by first fabricating a conventional shoe or boot to receive the foot of the user and then attaching wheels or blades to the shoe or boot by the use of a separate truck assembly or blade mount. However, it was found that for many applications, such as in-line roller skating, sufficient support was not provided by conventional shoe or boot assemblies. For in-line roller skates to provide both maneuverability and high speed operation, it is desirable that the skate be maintained in a substantially vertical position, and a high degree of support must be provided to the ankles of the skater.

Rigid injection molded boots which had previously been used for skiing, were adapted for in-line roller skating applications. These rigid boots generally include a plastic outer shell which forms the boot upper portion combined with a soft inner liner to provide comfort to the skater. To eliminate unwanted forward or rearward stiffness and rigidity, such boots have normally included a pivoted ankle support cuff at the back of the boot above a heel supporting section thereof. An example of a prior art injection molded boot with a pivoted heel cuff is shown by U.S. Pat. No. 5,092,614 to A. M. Malewicz. Although the pivoted ankle cuff alleviates, to some extent, unwanted forward and rearward stiffness in a skating boot, the boot is completely rigid in a lateral direction.

In an attempt to provide enhanced support for an in-line skate while maintaining the comfort of a conventional soft shoe or boot, Roller Derby Skate Corporation of Litchfield, Ill., in the late 1980's, designed and sold an in-line roller skate under the trademark DRY ICE. This in-line roller skate included a soft, pliable, breathable shoe having a rigid base secured to a skate truck assembly. At the back of the shoe, extending around the heel and ankle portion, was a more rigid plastic heel and ankle counter which was bonded to the shoe.

To eliminate the necessity of providing a separate, pivotal ankle cuff with an attendant pivoting mechanism in a molded skate boot, a unitary molded skate boot has been designed with a system of slits in the heel and ankle area to provide for flexure in the forward and rearward direction. A boot of this type is shown by U.S. Pat. No. 5,462,295 to E. Seltzer. This slitted boot assembly includes a flat hinge section extending between slits at the front and rear of the boot, and sometimes, after prolonged use, continued flexure can cause crazing of the plastic in this hinge section.

Recently, in an attempt to eliminate the disadvantages of the rigid, injection molded skate boots, there has been a return to the concept of combining a soft shoe or boot attached to a skate truck with a rigid or semirigid heel counter. Once such structure, shown by U.S. Pat. No. 5,437,466 to A. A. Meibock et al. includes a pivoted ankle cuff attached to the heel counter in the manner provided in previously designed injection molded skate boots. This boot is provided with a canting adjustment mechanism to allow the ankle support cuff to be canted laterally relative to the remainder of the boot.

Another development has been to increase the rigidity of softer, more comfortable skate boots by designing a plastic ankle and heel counter insert which can be positioned between the various layers which make up the skate boot. Such inserts have a heel counter portion which is generally U shaped and which extends around the heel area and along both sides thereof. An integral ankle support extends upwardly from the heel counter portion and includes forwardly projecting portions which extend around both sides of the ankle area. Such a one piece plastic ankle and heel counter insert is shown by International Patent Application No. PCT/CA94/000661 to BT Hoshizaki et al. While this one piece insert provides improved rigidity in the heel and ankle portions of the skate boot, it can inhibit to some extent rearward and lateral movement of a skater's ankle.

SUMMARY OF THE INVENTION

The skate boot construction of the present invention includes a unitary plastic heel/ankle counter insert which may be secured externally or internally to a soft boot mounted on a skate truck. The insert includes two spaced side portions joined by a U-shaped heel section which extend along the sides of a skater's foot. Above the side portions and the heel section are two forwardly projecting side flaps joined by an arcuate back section which are connected to the spaced side portions by two outwardly bowed hinge sections positioned over a skater's ankle bones. An arcuate slit extends through the heel/ankle counter between the heel section and arcuate back section and runs for a distance along either side of the heel/ankle counter. End slits extend transversely above and below each end of the arcuate slit. Cutaway portions below the side flaps extend inwardly toward the end slits and with the end slits define the edges of the bowed hinge sections.

A molded unitary in-line skate boot is provided using the ankle flexure construction of the heel/ankle counter. This boot includes an arcuate heel slit having enlarged ends and two inclined slits extending from the front of the boot toward the ends of the heel slit, both of which have enlarged inner ends. Alternatively, a flexible insert may be snapped into the boot at the ends of the slit which bridges each slit with an elastomeric member.

BEST MODE FOR CARRYING OUT THE INVENTION

Figure 1:
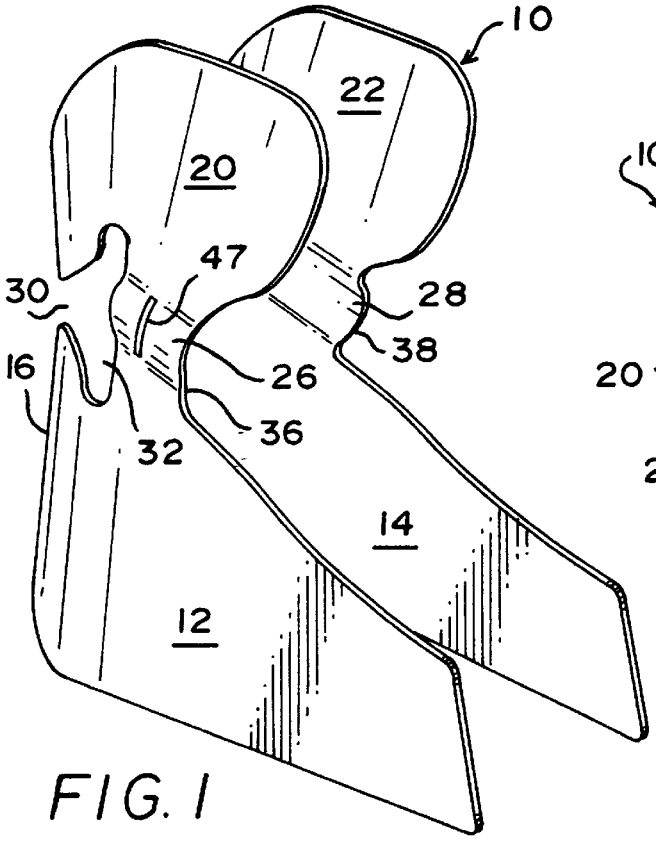
FIG. 1 is a perspective view of a heel/ankle counter insert for a skate boot of the present invention.
Figure 2:
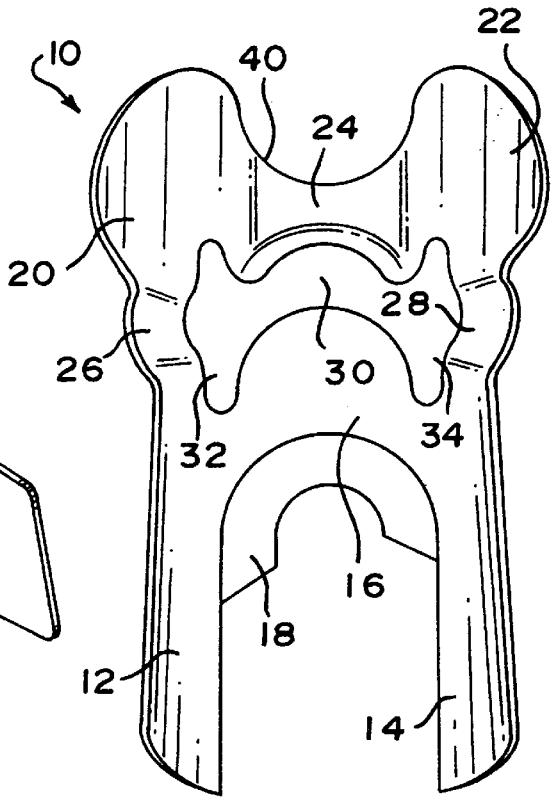
FIG. 2 is a view in front elevation of the heel/ankle counter insert of FIG. 1.
Figure 3:
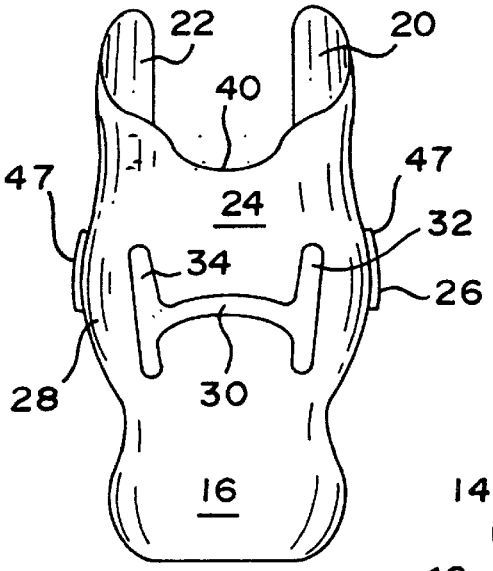
FIG. 3 is a view in rear elevation of the heel/ankle counter insert of FIG. 1.

Referring now to FIGS. 1–3, the novel heel/ankle counter insert of the present invention is illustrated generally at 10.

This heel/ankle counter insert is formed of thin, somewhat flexible plastic which is of sufficient rigidity to add support and rigidity to adjacent areas of the skate boot. The heel/ankle counter 10 is intended for use with a soft boot and not with more rigid injection molded plastic boots and may be employed either internally or externally of the soft boot. As will be noted from FIGS. 1 and 2, the heel/ankle counter 10 includes two spaced, substantially parallel side portions 12 and 14 that extend forwardly of a heel section 16 which bridges the side portions. The side portions 12 and 14 are designed to extend from the heel section forwardly beneath a skater's ankle and along the sides of the skater's foot to a forward terminus in the area of the arch of the skater's foot. The heel section 16 is an arcuate section which cups around the back of the skater's heel and is joined on either side by the side portions 12 and 14. Extending a slight distance forwardly and laterally from the heel section at the lowermost extremity thereof is an arcuate bottom wall 18 which would lie beneath the heel of a skater. This arcuate bottom wall is used to secure the heel/ankle counter insert 10 in position within a boot when the insert is inserted into the foot during assembly thereof.

Positioned above the side portions 12 and 14 and the heel section 16 are two spaced side flaps which project forwardly above the side portions from an arcuate back section 24 which joins the side flaps and extends above the heel section 16. The arcuate back section 24 extends around the back of a skater's leg above the ankle, and the side flaps 20 and 22 extend along the sides of a skater's leg above the ankle to substantially the front surface of a skater's leg.

The side flaps 20 and 22 are joined to the spaced side portions 12 and 14 respectively by outwardly bowed hinge sections 26 and 28. These outwardly bowed hinge sections extend over the ankle bones of a skater's foot and function for the dual purpose of providing additional space for a skater's ankle bones while providing a hinge for forward and rearward movement as well as limited lateral movement of the side flaps 20 and 22 and the arcuate back section 24. To facilitate this movement, an arcuate slot 30 is formed to extend through the heel/ankle counter between the heel/ankle section 16 and the arcuate back section 24 and this slit then extends for a limited distance around the sides of the heel/ankle counter between the side flaps 20 and 22 and the spaced side portions 12 and 14. The ends of the slot 30 are provided with widened apertures 32 and 34 which extend above and below the slot 30 at either end thereof. These widened apertures are shown as transverse end slits in FIGS. 1–4, but they may be formed in other shapes. The apertures 32 and 34 extend through the heel/ankle counter and define the rearmost sides of the hinge sections 26 and 28. The apertures 32 and 34 extend above and below the outwardly bowed portions of the hinge sections 26 and 28.

The heel/ankle counter 10 is provided with cutaway portions 36 and 38 which extend between the forward edges of the side flaps 20 and 22 and the spaced side portions 12 and 14 to form the forward edges of the hinge sections 26 and 28. These cutaway portions extend arcuately inward toward the apertures or slits 32 and 34 and are located between the upper and lower extremities of the apertures or slits so that the hinges 26 and 28 are free to move both forwardly and rearwardly.

As will be noted from FIG. 2, the arcuate slot 30 is arched upwardly relative to the bottom wall 18 to provide a heel section 16 having an upper arched edge, and the bottom edge of the arcuate back section 24 is also arched upwardly. However, the top edge 40 of the arcuate back section 24 is also preferably arcuately shaped to curve downwardly between the side flaps 20 and 22 toward the arcuate slot 30. For some boot applications, however, the top edge 40 may be a straight edge or may even be curved upwardly.

Figure 4:
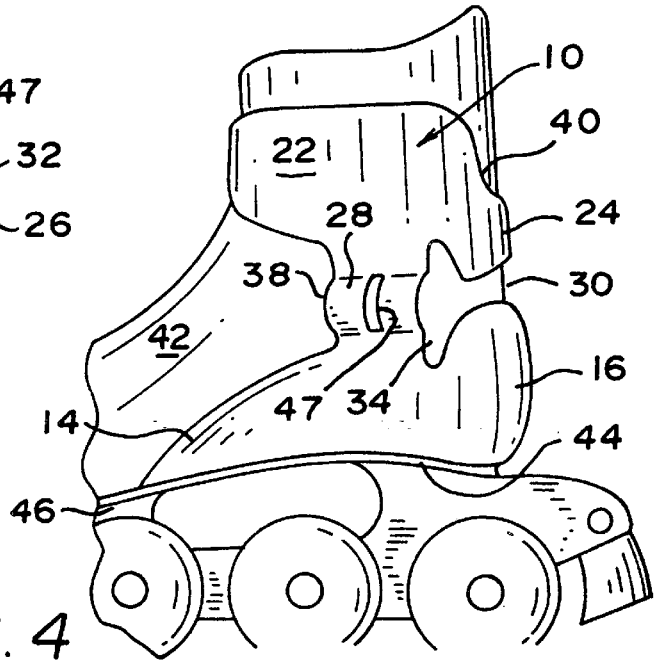
FIG. 4 is a side view of the heel/ankle counter insert of FIG. 1 secured externally to a soft skate boot.

The one piece heel/ankle counter 10 maybe positioned externally of a soft boot 42, as shown in FIG. 4, or maybe positioned in the same position internally within the soft boot. As illustrated in FIG. 4, the soft boot 42 is secured to a base 44 which is in turn secured to a skate truck 46. The forward end of the base 44 may include a toe engaging portion which extends upwardly around the toe of the soft boot 42 and is secured thereto. Also secured to the base 44 and extending around the outside of the soft boot 42 is the heel/ankle counter 10. Here, at least the portion of the heel/ankle counter below the hinge sections 26 and 28 is secured to the soft boot, and preferably, the side flaps 20 and 22 and arcuate back section 24 are also secured to the soft boot. Generally, the bowed hinge sections 26 and 28 would not be secured to the soft boot to enhance flexibility, but if the side walls of the boot are quite soft, the hinge sections may also be secured to the boot. A suitable strap and buckle, not shown, may be attached respectively to the side flaps 20 and 22 to attach the forward edges of the side flaps together around a skater's leg when the heel/ankle counter 10 is formed externally on the soft boot 42.

The combination of the inwardly extending cutaway portions 36 and 38, the slot 30, and the apertures 32 and 34 permit the flaps 20 and 22 and the arcuate back section 24 to pivot forwardly and rearwardly, relative to the spaced side portions 12 and 14 and the heel section 16. This pivotal action occurs at the hinge sections 26 and 28, and the outwardly bowed portions of the hinge sections flex in a nearly elastic manner which prevents this area from crazing due to pivotal movement. For example, as a skater's leg pivots rearwardly against the arcuate back section 24, the arcuate back section tends to pivot downwardly into the slot 30 closing the upper portions of the apertures or slits 32 and 34. However, this does not place a stress on the hinge sections 26 and 28 which might ultimately result in crazing of these sections, for as this backward pivotal movement occurs, the outwardly bowed portions of the forward edges of the hinge sections 26 and 28 tend to flatten inwardly while the rear edges bow further outwardly, thereby relieving the stress on the hinge sections. The reverse action occurs when a skater's leg pivots forwardly causing the slot 30 to open and the rearward bowed edges of the hinge sections 26 and 28 to flatten while the forward edges bow outwardly to remove stress.

Similarly, as a skater's leg inclines laterally in one direction, the hinge section on the side toward which the movement occurs tends to bow further outwardly while the opposite hinge section tends to flatten to some extent. Thus, the outwardly bowed hinge sections 26 and 28 combined with cutaway portions 36 and 38, the slot 30, and the apertures 32 and 34 facilitate movement without overly stressing the hinge sections 26 and 28 and while still providing a unitary somewhat rigid support for the soft boot 42.

The same action occurs when the heel/ankle counter insert 10 is formed internally within the soft boot 42 to provide an internal support for the soft boot. This often occurs by inserting the heel/ankle counter between layers of the soft boot 42 and bonding the unit in place.

It is desirable for the heel/ankle counter insert 10 to provide more lateral stiffness against lateral ankle movement than it provides against forward and rearward movement. To accomplish this, at least one vertical stiffener rib 47 may be formed on each hinge section 26 and 28 to provide a thicker area of plastic which opposes lateral ankle movement. The stiffener rib or ribs should be positioned in the central area of each hinge section so that they don't significantly oppose forward or rearward ankle movement.

Figure 5:
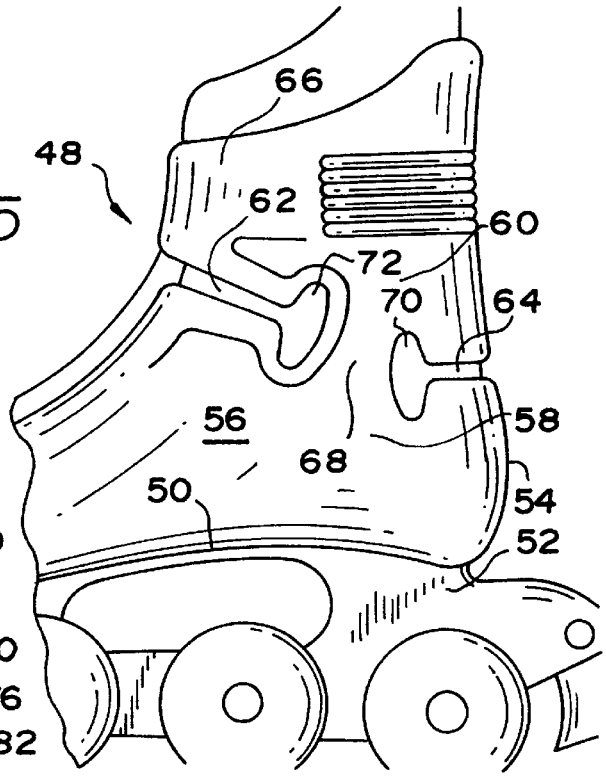
FIG. 5 is a partial view in side elevation of a molded unitary in-line skate boot of the present invention.

Referring to FIG. 5, a unitary injection molded in-line skate boot indicated generally at 48 can be formed using a slot configuration similar to that shown for the insert 10 to relieve stress and crazing of the boot caused by forward and rearward movement of the skater's leg. The boot 48 has a sole 50 which is secured to a skate boot 52. This boot has a heel portion 54 from which extend opposed spaced side walls, one of which is shown at 56, which connect the heel portion of the boot to the a toe portion not shown. The boot also includes an ankle portion 58 positioned in the area of the ankle of a boot wearer spaced forwardly of the heel portion 54, and a boot upper 60 extends above the ankle portion. The side of the boot 48 not shown in FIG. 5 is identical in construction to the side illustrated, and contains all of the components of the side illustrated.

In most molded in-line skate boots, the boot upper normally includes a support cuff which is pivoted to the ankle portion of the boot so that the boot can move forwardly and rearwardly above the pivot point during a skating motion. In the unitary molded boot 48, this separate pivoted cuff is eliminated and is replaced by two inclined ankle slots 62 on either side of the boot and a heel slot 64, all of which extend completely through the boot. The heel slot 64 is an arcuate slot formed to extend completely around the back surface of the boot and for a limited distance along the opposed side walls 56 thereof. This slot is positioned at the point where the boot upper 60 joins the ankle section 58. Above the slot 64 in the front of the boot, two upper flaps 66, one of which is shown in FIG. 5, are formed, and these flaps are joined together by a suitable strap and latching assembly. The lower edges of the flaps 66 are defined by the inclined slots 62 which are of a triangular, pie shaped configuration and which incline rearwardly and downwardly on either side of the boot from the front thereof to a point spaced from and slightly above the slot 64. The slots 62 operate with the slot 64 to define a hinge sections 68 on opposite sides of the skate boot between the ends of the slot 64 and the ends of the slots 62. To permit the upper 60 to pivot easily about the hinge sections 68, the distances between the ends of the slots 62 and the slot 64 should be no more than one half of the distance across one side of the upper 60, and usually this distance is less than one half. The hinge sections 68 may be bowed outwardly in the same manner as the hinge sections 26 and 28 of FIG. 1 to permit enhanced elastic movement.

Over a prolonged period of time, with conventional slots 62 and 64, pivotal movement of the upper 60 relative to the ankle portion 58 of the boot 48 could cause crazing of the plastic in the area of the hinge sections 68. This problem can be alleviated by providing enlarged apertures 70 at the opposite ends of the slot 64 and by providing enlarged apertures 72 at the innermost end of each slot 62. These enlarged apertures extend above and below the associated slot, and permit the walls of the slot to move apart or together at the apertures as the upper is pivoted. This relieves stress on the hinge sections 68.

Additional relief for the hinge sections 68 can be provided by mounting a flexible elastomer adjacent to the inner ends of the slots 62 and at the ends of the slot 64. This elastomer can be molded in place, but ideally is included in a flexible insert which can be snapped into the boot. One form of this flexible insert is shown in FIGS. 6 and 7.

Figure 6:
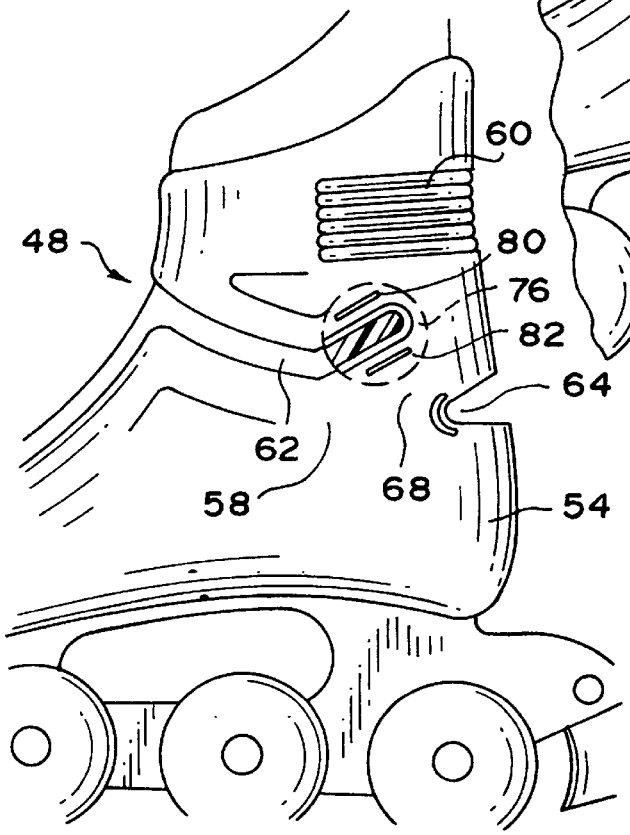
FIG. 6 is a partial view in side elevation of a second embodiment of a molded unitary in-line skate boot of the present invention.
Figure 7:
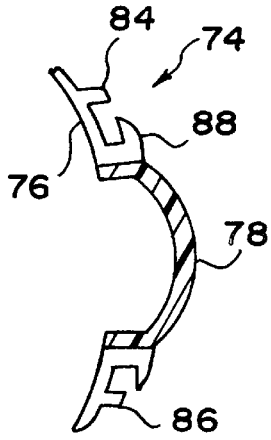
FIG. 7 is a sectional view of a flexible insert for the molded unitary in-line skate boot of FIG. 6.

Referring to FIGS. 6 and 7, a flexible insert indicated generally at 74 includes a plastic body 76 which carries an elongate elastomeric unit 78 intended to fit into the end of a slot 62 or a slot 64. In FIG. 5, the slots 62 in the skate boot 48 angle upwardly at the ends thereof, and insert receiving slots 80 and 82 are formed in the boot to receive the inserts 74. The body 76 of the insert 74 is formed of a plastic material having some flexibility and is provided with projections 84 and 86 on either side of the elastomeric unit 78 which snap into the slots 80 and 82. Also the body of the insert 74 includes a flange 88 around the elastomeric unit 78 which snaps over the edge of the slot 62 to position the elastomeric unit within the slot 62. Inserts of this type can be used both at the ends of the slots 62 and also at the ends of the slot 64 in place of the enlarged openings 70 and 72. These inserts relieve stresses which may cause crazing of the hinge sections 68 for the boot 48.

We claim:

1. A skate comprising:

a soft, pliable, substantially non-rigid boot for receiving a skater's foot, said boot including a heel portion, first and second opposed side wall portions extending longitudinally from said heel portion, and a rigid sole portion extending between said side wall portions and said heel portion to define a cavity within said boot for receiving portion of a skater's foot which is supported and enclosed thereby, a one-piece, heel/ankle counter secured to said boot to extend along the heel and sidewall portions thereof and provide added support to the boot, said one-piece heel/ankle counter including a U-shaped counter heel portion, two spaced counter side portions extending in a common direction from said counter heel portion, two spaced side flaps positioned above said counter side portions, an arcuate counter back section positioned above said U-shaped counter heel portion and extending between said spaced counter side flaps, and two spaced bowed hinge sections not directly attached to said boot extending between said counter side portions and said side flaps, each hinge section extending between one of said counter side portions and side flaps and being bowed outwardly away from the remaining hinge section, and a skate support structure secured to said rigid sole portion and extending outwardly therefrom.

2. The skate of claim 1 wherein said heel/ankle counter is secured externally to said boot.

3. The skate of claim 1 wherein said skate support structure includes a skate truck for skate wheels.

4. A skate comprising:

a soft pliable, substantially non-rigid boot for receiving a skater's foot, said boot including a heel portion, first and second opposed side wall portions extending longitudinally from said heel portion, and a rigid sole portion extending between said side wall portions and said heel portion to define a cavity within said boot for receiving a portion of a skater's foot which is supported and enclosed thereby, a one-niece, heel/ankle counter secured to said boot to extend along the heel and sidewall portions thereof and provide added support to the boot, said one-piece heel/ankle counter including a U-shaped counter heel portion.

two spaced counter side portions extending in a common direction from said counter heel portion.

two spaced side flaps positioned above said counter side portions.

an arcuate counter back section positioned above said U-shaped counter heel portion and extending between said spaced counter side flaps.

a heel slit extending through said heel/ankle counter and positioned between said U-shaped counter heel portion and said arcuate counter back section, and two spaced bowed hinge sections extending between said counter side portions and said side flaps, each hinge section extending said counter side portions and said side flaps, each hinge section extending between one of said counter side portions and side flaps and being bowed outwardly away from the remaining hinge section, and a skate support structure secured to said rigid sole portion and extending outwardly therefrom, said skate support structure including a skate truck for skate wheels.

5. The skate of claim 4 wherein said heel slit includes a first and a second end, each of such heel slit ends being positioned adjacent to one of said bowed hinge sections and including an opening formed in said heel/ankle counter extending transversely above and below said heel slit to define a rear edge of a bowed hinge section.

6. The skate of claim 5 wherein said one-piece heel/ankle counter includes a cutaway portion provided between each of said counter side portions and a side flap to define a forward edge of a hinge section, each said arcuate cutaway portion extending inwardly toward said heel slit.

* * * * *